US009330549B2

(12) United States Patent
Kellermann et al.

(10) Patent No.: US 9,330,549 B2
(45) Date of Patent: May 3, 2016

(54) SMART SCREENING BARRIER AND SYSTEM

(71) Applicants: David Gustav Kellermann, Iklin (MT); Andrey Kuznetsov, St. Petersburg (RU); Igor Gorshkov, St. Petersburg (RU)

(72) Inventors: David Gustav Kellermann, Iklin (MT); Andrey Kuznetsov, St. Petersburg (RU); Igor Gorshkov, St. Petersburg (RU)

(73) Assignee: APSTEC SYSTEMS USA LLC, Owings Mills, MD (US)

( * ) Notice: Subject to any disclaimer, the term of this patent is extended or adjusted under 35 U.S.C. 154(b) by 6 days.

(21) Appl. No.: 14/259,603

(22) Filed: Apr. 23, 2014

(65) Prior Publication Data

US 2015/0310713 A1 Oct. 29, 2015

(51) Int. Cl.

| | |
|---|---|
| ***G08B 13/22*** | (2006.01) |
| ***G07C 9/00*** | (2006.01) |
| ***G08B 13/196*** | (2006.01) |
| ***G08B 15/00*** | (2006.01) |
| ***E06B 3/90*** | (2006.01) |
| *E05G 5/00* | (2006.01) |

(52) U.S. Cl.

CPC ..... *G08B 15/007* (2013.01); *E06B 3/90* (2013.01); *E05G 5/003* (2013.01)

(58) Field of Classification Search

CPC ..... E05G 5/02; G01S 13/887; G07C 9/00126; G08B 13/19634; G08B 13/22

USPC ..... 49/68; 109/3; 340/5.7, 541

See application file for complete search history.

(56) References Cited

U.S. PATENT DOCUMENTS

| | | | | |
|---|---|---|---|---|
| 4,060,039 | A * | 11/1977 | Lagarrigue | 109/3 |
| 5,992,094 | A * | 11/1999 | Diaz | E05G 5/02 109/6 |
| 6,057,761 | A * | 5/2000 | Yukl | 340/568.1 |
| 6,742,301 | B1 * | 6/2004 | Schwarz | 49/42 |
| 6,745,520 | B2 * | 6/2004 | Puskaric | E05G 5/003 49/142 |
| 7,272,721 | B1 * | 9/2007 | Hellenthal | 713/182 |
| 8,171,864 | B2 * | 5/2012 | Mucio | 109/6 |
| 2007/0047837 | A1 * | 3/2007 | Schwab et al. | 382/285 |
| 2008/0129502 | A1 * | 6/2008 | Fuse | G08B 13/2402 340/568.1 |
| 2008/0303708 | A1 * | 12/2008 | Daly et al. | 342/22 |
| 2010/0182434 | A1 * | 7/2010 | Koch et al. | 348/164 |
| 2015/0113883 | A1 * | 4/2015 | Wang et al. | 52/1 |

* cited by examiner

*Primary Examiner* — Fekadeselassie Girma
*Assistant Examiner* — Stephen Burgdorf
(74) *Attorney, Agent, or Firm* — Nadya Reingand

(57) ABSTRACT

A barrier and system for the protection of a crowd from terrorists, by evaluating each individual for any concealed prohibited items. Each individual is exposed to one or more screening mechanisms, controlled by a monitoring unit, while passing in an organized fashion through an enclosed walkway containing the screening mechanism, and exiting on the other side. When a prohibited object is detected, response is provided and the smart door device is locked to detain and isolate the suspected individual in the device structure's interior. The structure of the invention is also configured to deflect the blast created by a potential explosion and prevent harm to other individuals and structures nearby.

19 Claims, 7 Drawing Sheets

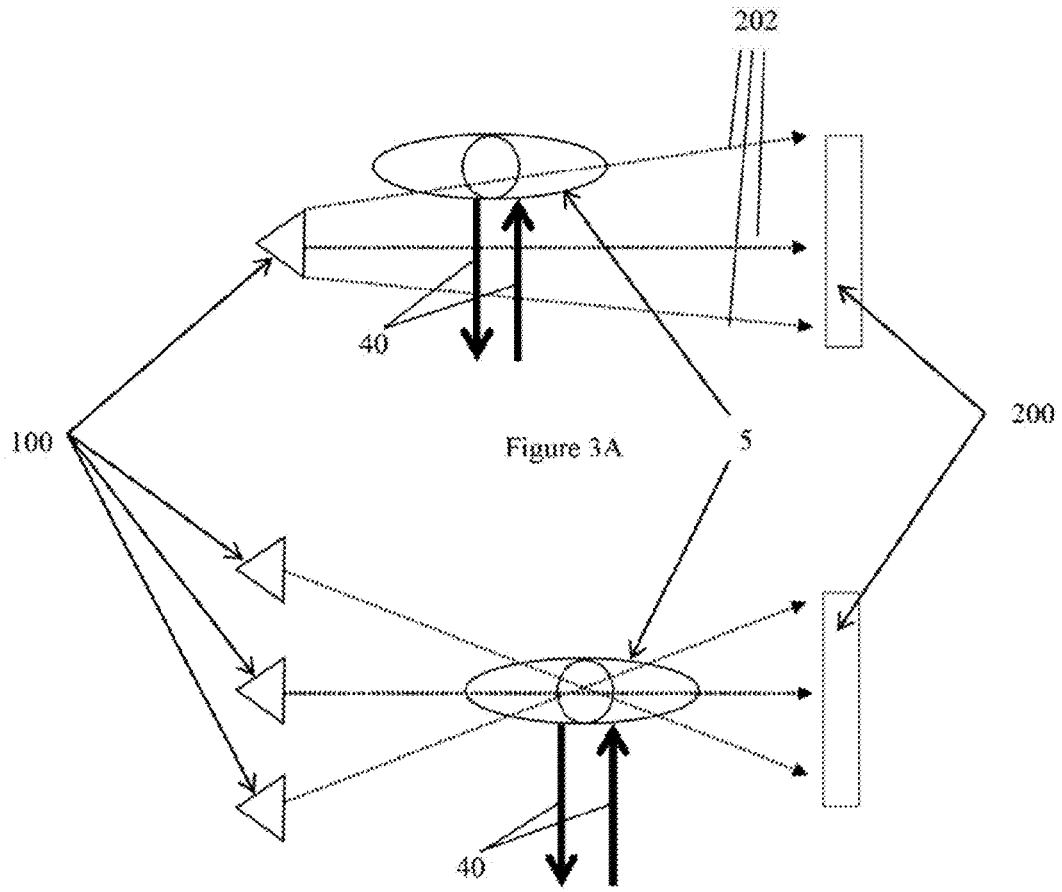
Figure 3A
Figure 3B
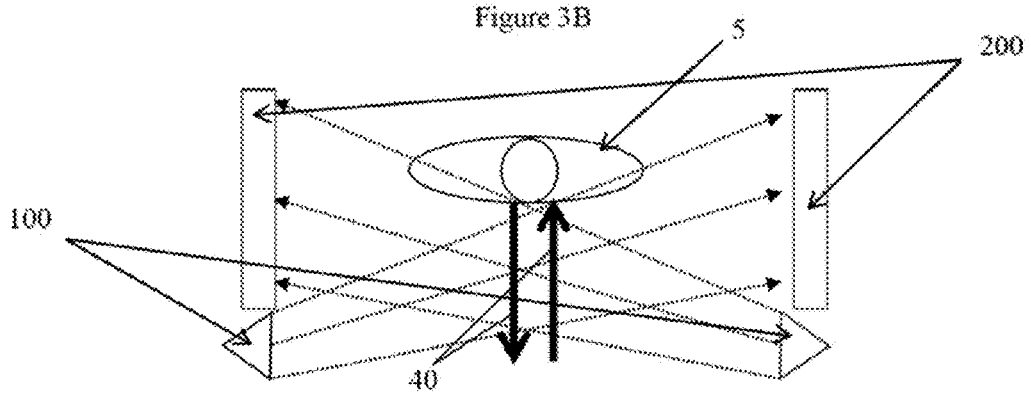
Figure 3C

SMART SCREENING BARRIER AND SYSTEM

CROSS-REFERENCE TO RELATED APPLICATIONS

This patent application claims priority to, and incorporates fully by reference, U.S. Provisional Patent Application No. 61/945,921, filed Feb. 28, 2014.

FIELD OF THE INVENTION

This invention relates to a security barrier for the controlled transit of people, animals, and carried items, particularly for tourist attraction areas, high-capacity and high-flow areas, and mass transit areas such as train stations and airports.

BACKGROUND OF THE INVENTION

U.S. Patent Application No. 2003/0136052, by De Boer, discloses a revolving door, comprising a rotatable partition embodied such that in, at, or on the partition, one or more means for the detection of inadmissible goods is provided. U.S. Pat. No. 6,742,301, to Schwarz, also discloses a revolving door, but with a metal detection function. Both inventions are a kind of automatic detection device, but are short in their capability of dealing with an individual who might be wearing or carrying a hidden dangerous object.

U.S. Pat. No. 7,707,951, to Prasad, discloses a substantially automatic, robotic-like system to aid in preventing crime in high trafficked buildings and other public sites, comprising a counterclockwise rotating door which permits access in one direction only and is manually operated, two personnel detecting sensors, at least two other detectors, a low voltage power source and low voltage electronics, an electronic design to substantially automatically detect and detain persons attempting to enter a protected facility with a weapon or leave with a protected item, and where the entire security system is essentially contained within the space employed by the entry and or exit doorway.

Prior art terrorist uncovering schemes, including but not limited to those mentioned above, are dangerous, since a terrorist most often detonates when realizing he has been caught in order to injure as many bystanders as possible. Security personnel who must approach a potential suicide bomber stand a very high risk, which also potentially impairs effectiveness of the security approach. It is advantageous to first detect potential target individuals and then confine them, in a secluded manner, to prevent harm to bystanders even if the target immediately detonates a worn explosive.

Additional challenges include: (1) how/where to install the system to achieve the maximum benefit, and (2) how the end user will treat cases of detection. Since a certain rate of false alarms will occur, there is a need for confirmation systems, and when a real threat is detected, it is essential to reduce as much possible damage as possible, e.g., by separating the threat from surrounding individuals and structures. These aspects should also be achieved while retaining acceptable traffic flow, or at least with minimal interruption of the same.

SUMMARY OF THE INVENTION

The present invention claims a security barrier and system for the screening of individuals, e.g., for application in areas with high traffic flows. The invention comprises at least two revolving door mechanisms, or alternatively, automatic doors, used as entrance and exit points to/from an isolated area located between the doors. The doors, as well as the walls and surrounding structures of the isolated area, are made of blast-resisting glass and/or concrete, in order to mitigate a potential explosion or other act of terrorism. Screening mechanisms are employed in the isolated area as well as within the entrance and exit points. More screening devices/mechanisms lower the likelihood of false alarms and allow for further confirmation of suspected individuals. Various means for screening can be used including, but not limited to, metal detection, microwave imaging, video imaging, and infrared imaging. An alarm can be triggered if a signal from any of the screening mechanisms exceeds a pre-determined threshold value. Alternatively, a silent alarm can be triggered in a similar fashion, in order to alert and obtain first responders before alarming an individual carrying a potential explosive.

BRIEF DESCRIPTION OF THE DRAWINGS

FIG. 2.

FIG. 3 (top view). FIG. 3A shows an example of one embodiment of the present invention, where one transmitter, or transmitting array, sending various signals to one receiver. FIG. 3B shows another embodiment of the present invention, where one transmitting array send various signals to various receivers. FIG. 3C shows yet another embodiment where several transmitters and receivers are employed together.

FIG. 5 (side view/view from the front or back). FIG. 5A regards transmitting means of detection. FIG. 5B regards reflecting means of detection.

DETAILED DESCRIPTION OF THE PREFERRED EMBODIMENT

Definitions

Figure 1:
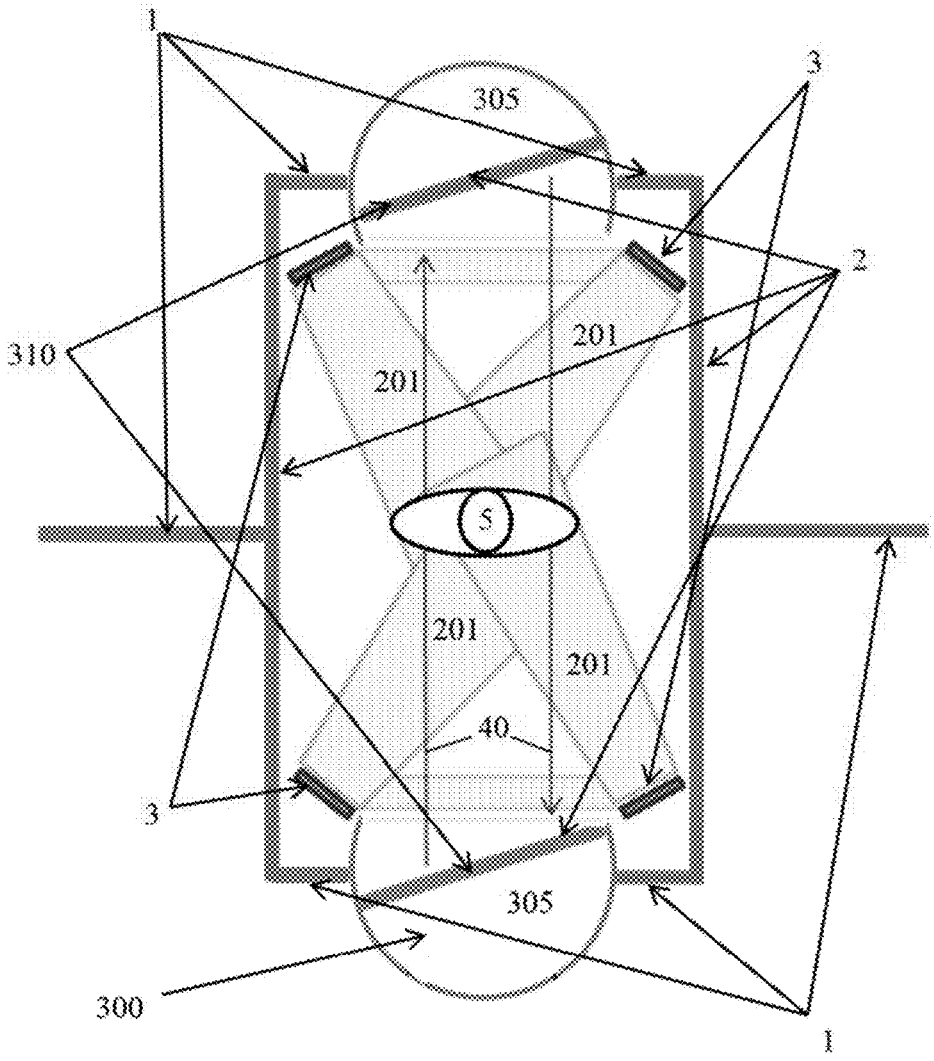
FIG. 1 shows an example (top view/view from above) of the present invention, illustrating how a screening area is located between two revolving doors and how receivers and transmitters can be positioned in the area between doors. It also shows an example of how the concrete and blast-resistant materials/barriers can be positioned.

"Means for detection," as used herein, refer to various means for screening/detection which are applicable with the presently claimed system including, but not limited to, metal detection, microwave detection, video detection, microwave-video imaging, infrared detection, electromagnetic imaging, x-ray imaging, ultrasonic imaging, ultrasound imaging, and other known methods. Methods of detection disclosed by the following patents are incorporated herein fully by reference and exemplify, without limiting, alternate means of detection compatible with the present invention: U.S. Pat. No. 8,159,534, to Kuznetsov et al., U.S. Pat. No. 8,228,374, to Kuznetsov et al., U.S. Pat. No. 6,791,487, to Singh et al., U.S. Pat. No. 6,469,624, to Whan et al., U.S. Pat. No. 5,600,303, to Husseiny et al, and PCT/US Patent Application No. PCT2013/027932, filed by Bergen et al.

"Microwave (MW) imaging," as used herein for the means of detection, can be achieved using various techniques. In one embodiment, the active microwave detection means disclosed in U.S. Patent Application No. 2014/160,895 (using methods based on the reflective characteristics of microwaves off of dielectric objects hidden underneath clothing or within luggage) are used to detect potentially dangerous objects within the system claimed herein. This document is also fully incorporated herein by reference as one means of detection. See also U.S. Pat. No. 8,159,534, to Kuznetsov et al., U.S. Pat. No. 8,228,374, to Kuznetsov et al., which are also mentioned above as additional applicable means for detection. In some embodiments, the MW imaging is performed by reflecting microwaves, while other embodiments employ a transmitted MW imaging method, as detailed in the patents listed above or described herein. In yet other embodiments, the active microwave detection means can be coupled with means for video imaging (e.g., video cameras) in order to create a synchronized real-time image combining both microwave and video images of the same target at the same point in time.

The term "adjacent," as used herein, is defined as touching (i.e. in contact with), or within 5 meters of, any outside boundary of a barrier or smart room as described herein. The term is used to describe the positioning of blast-resistant concrete material structures which may be placed near or along the screening areas described herein. Such material structures, used, e.g., to minimize a blast radius, are placed in various strategic locations around a screening area, but they must be positioned within a certain range in order to be beneficial.

The present invention improves on prior art methods by adding the capability to detect subjects at a forced (even if only slightly different) slower pace due to the revolutions of the revolving door (or any other automatic door, these terms can be substituted for one another in all embodiments discussed herein) and the maximum capacity within each section of the revolving doors. Additionally, the present invention improves on prior art methods because as a potential target is determined to be a potential threat, he or she is immediately isolated, and even if an explosive is detonated, individuals nearby will not be harmed because of the strategically placed revolving door and the surrounding structural components (including, but not limited to, concrete-containing barriers and blast-resistant glass strategically placed in specific locations to isolate a detonated explosive within or near the revolving door.

FIG. 1 shows an example of a smart room with two revolving doors acting as entrance and exit (top view). The revolving doors are formed within stationary cylinders 300 comprising at least one blade 310 comprised of blast-resistant material or concrete, but preferably glass (see FIG. 2B). The blades 310 create sections 305 within each stationary cylinder 300, and each stationary cylinder acts as either an entrance point or an exit point for moving individuals. Two types of barriers examples are illustrated in FIG. 1: concrete walls 1 (which could be installed in pre-fabricated sections), and blast-resistant glass or other blast-resistant material 2, which is used both in wall material and in revolving door material. The walls and doors combine to form the "smart room," wherein various detection methods can be used to screen individuals moving through the space. Every material which makes up the smart room is comprised of blast-resistant glass and/or concrete, which also minimizes the effect of a potential explosion or other dangerous act. FIG. 1 also shows an example of how any means of detection 3 can be positioned in the corners of a screening area in order to obtain various interrogating areas 201. Individuals/traffic 5 can move in either direction 40, thus each revolving door can act as a means for entering and as a means for exiting, depending on the direction of movement of a given individual.

Figure 2A:
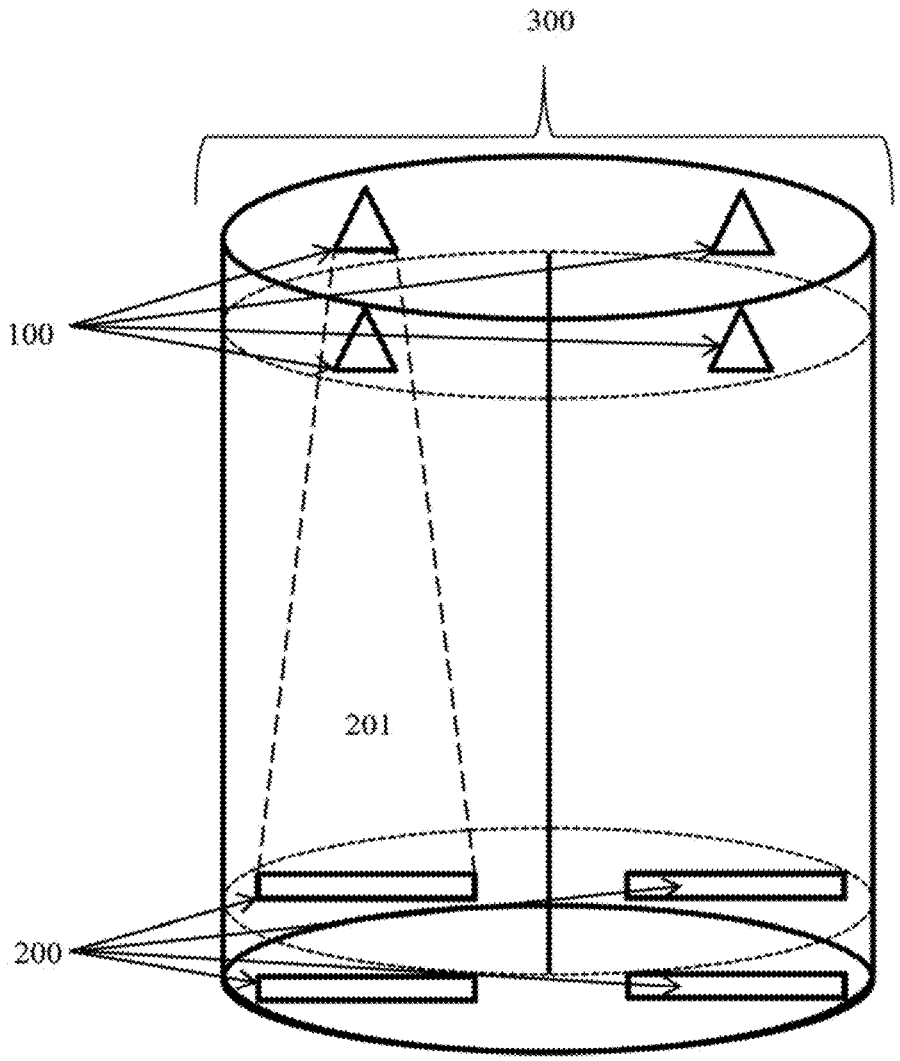
FIGS. 2A and 2B show examples of how receivers and transmitters can be positioned within a revolving door itself—(2A) from top to bottom (side view), and (2B) from inside axel to outside boundary (top view).
Figure 2B:
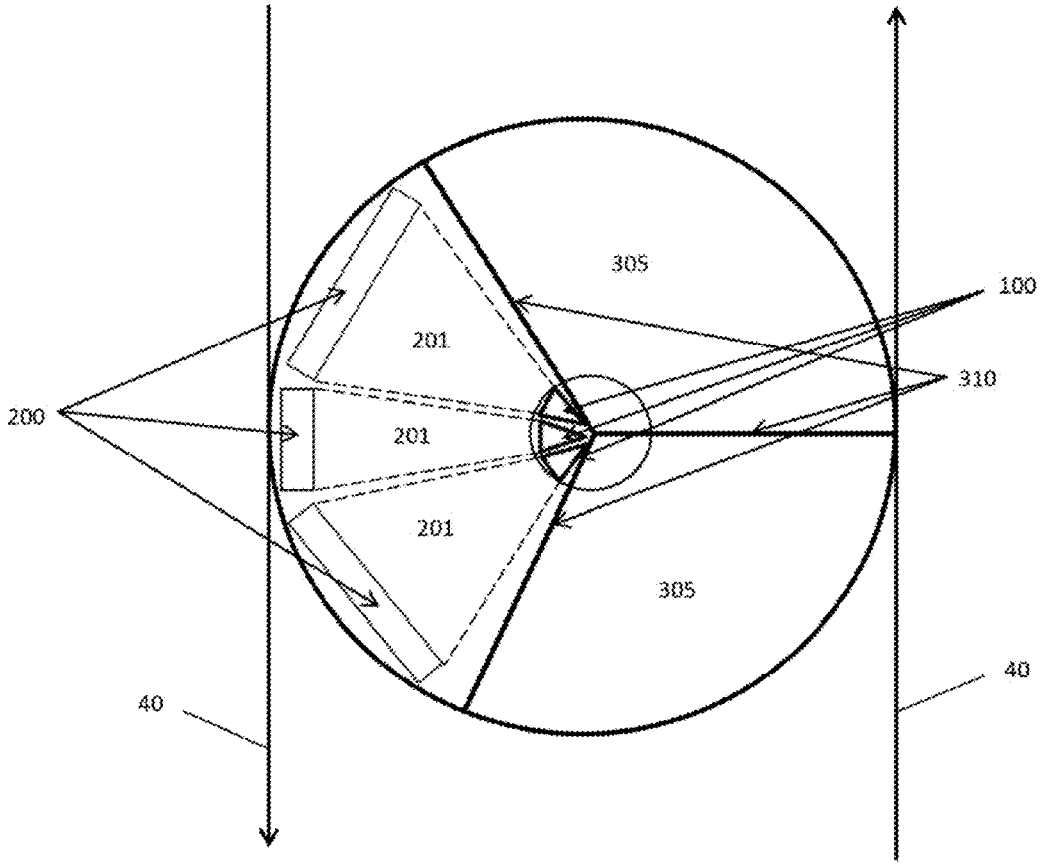

FIGS. 2A and 2B shows examples of how receivers 200 and transmitters 100 can be positioned within a revolving door, either (2A) transmitting from the bottom portion of the door to the top portion of the door, and vice versa; or (2B) from the outside boundary of the door to the inner boundary, and vice versa. As shown, several transmitters 100 and receivers 200 can be positioned along different portions of a door in order to obtain as many interrogating areas 201 as needed. Referring to FIG. 2B, each section 305 of each revolving door 300, separated by blades 310 made of blast-resistant material or concrete, can comprise the same setup for means of detection as depicted in only one of the sections 305 in the figure. This allows for continuous flow and screening of individuals, as they move in either direction 40. If a high potential exists for false alarms, an embodiment employing additional means for detection within the revolving doors will help to lower the rate of such false alarms by screening a target several times (e.g., once in the first revolving door, a second time in the area between doors, and even a third time in the second revolving door). This particular embodiment, due to the ability to screen in more areas of the system, allows for a potentially faster flow of traffic but might also risk harm to more individuals because greater flow will lead to potentially more persons being located within the system at the same time (i.e., at a time when a threat is also located in the same area).

FIGS. 3A, 3B, and 3C depict examples of various embodiments of placing the transmitters and receivers for means of detection employing transmitted signals. As a given individual 5 moves through a screening area, and in either direction 40, a transmitter, or array of transmitters 100, transmits various signal at various angles 202 to one receiver 200 (FIG. 3A) or to various receivers 200 (FIG. 3B). It is irrelevant on which side the transmitters and receivers are located so long as they are across from each other at any angle (note: for reflecting means of detection, the receivers and transmitters must be on the same side). FIG. 3C shows an example employing two transmitters, or arrays of transmitters 100 sending signals to two receivers 200, creating two screening areas via signals at various angles.

Figure 4:
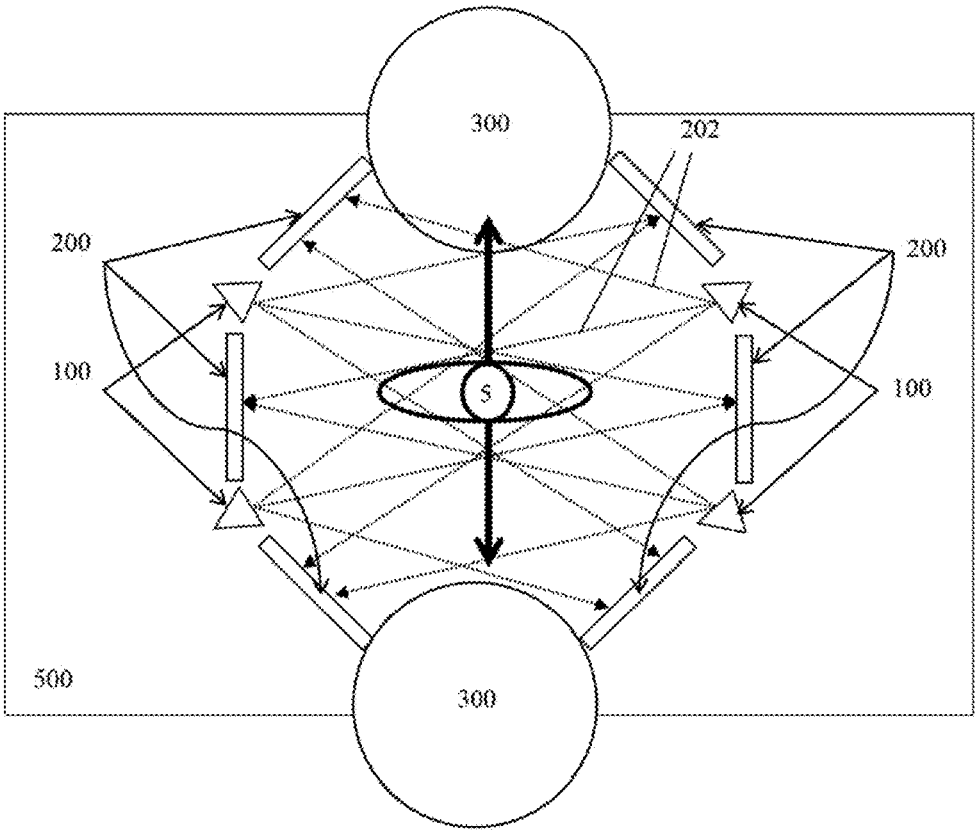
FIG. 4 (top view) shows another embodiment of the present invention, where various transmitters and receivers of the means for detection are positioned in a circular fashion within a smart room between entrance and exit points.

FIG. 4 shows another example of a smart room 500 between two revolving doors 300 with a means of detection employing 6 transmitters 200 and 4 receivers 100, in a circular fashion. The various angles of signals 202 create many screening areas and viewpoints, thus allowing for greater detection accuracy as individuals 5 move through the smart room 500.

Figure 5A:
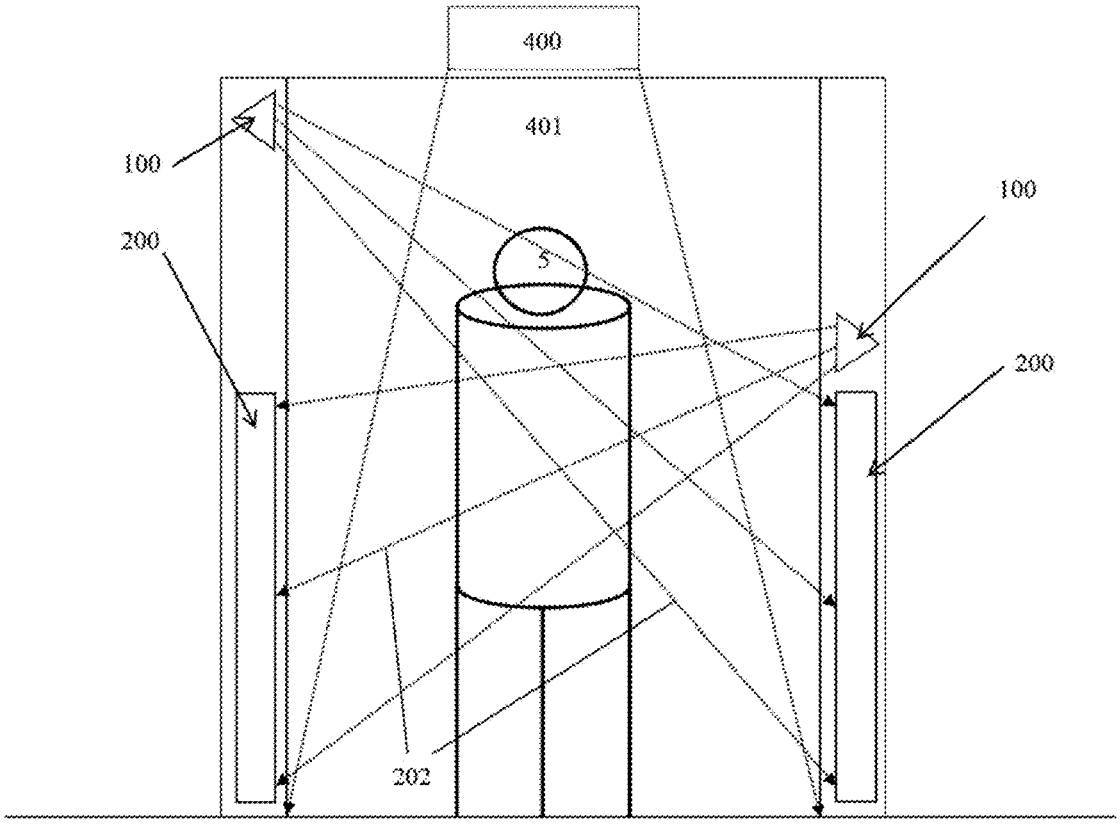
FIGS. 5A and 5B show examples of the heights at which receivers and transmitters can be positioned to obtain various screening angles, as well as the coupling of a second means for detection—a video imaging system.
Figure 5B:
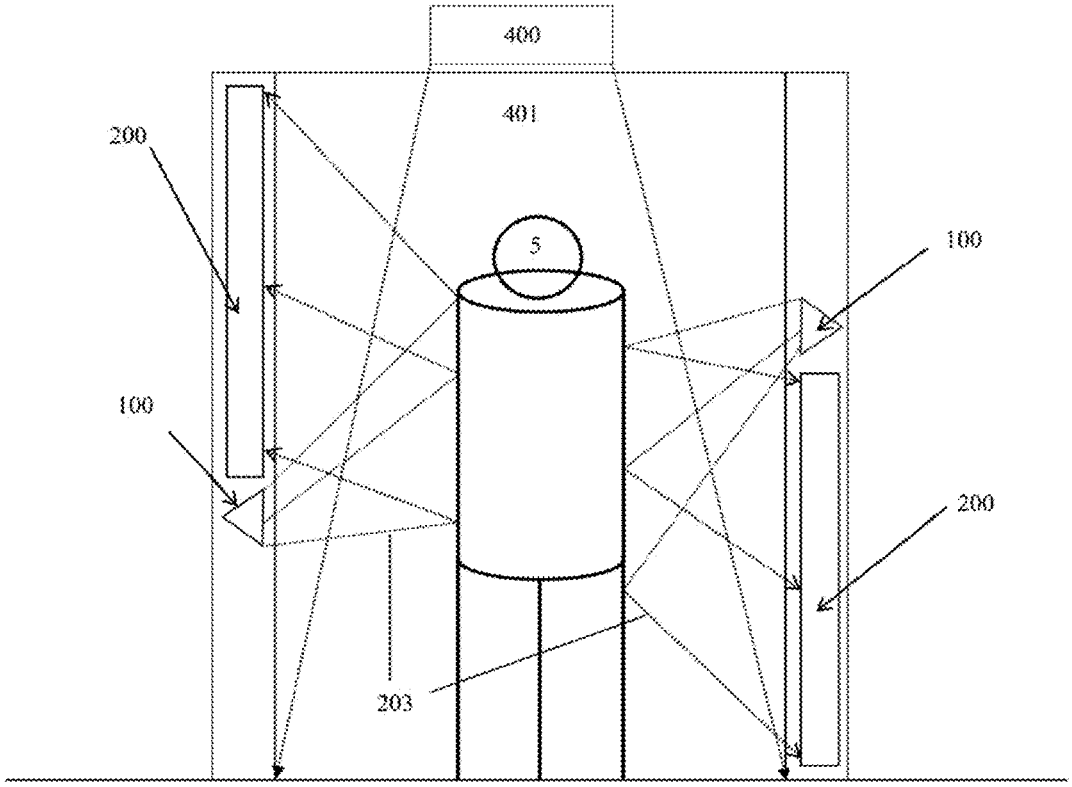

FIGS. 5A and 5B (side view, corresponding to top views shown in FIGS. 3A, 3B, 3C, and 4) shows an example of the various heights transmitters 200 and receivers 100 can be positioned, either within a smart room or within a door, creating various angles of signals (transmitted signals 202, or reflected signals 203) for detection. FIG. 5A depicts a transmitting signal 202 detection system. FIG. 5B depicts a reflecting signal 203 detection system. Additionally, these figures show an example of how a video imaging system 400 can be positioned to create an additional video screening area 401 thus forming, e.g., a combined MW-video imaging system. The additional video imaging can be synchronized with the MW imaging in real time to allow for more accurate identification of materials or individuals (e.g., an aspect that MW imaging, or any other coupled detection means, might not be able to obtain in time).

In one embodiment of the present invention, the detection means is located in an area 500 located between two or more revolving doors 300 (i.e. the smart room, isolated area). Thus, in this embodiment, the revolving doors 300 act only as a flow-controlling mechanism and not as a screening mechanism. By only allowing a maximum capacity (e.g., one person per section 305 of each revolving door 300, or two persons per section, and so on, based on the amount and size of the sections) of individuals to enter the smart room 500 at a time, the revolving doors act as a barrier to entering a screening area termed the smart room, which employs any means of detection known in the art or otherwise disclosed herein. Controlling the speed (e.g., slowing down) of traffic minimizes the chance of overlapping individuals (which causes screening problems, potentially hiding objects because of a shadowing/hiding effect), and creates a steady flow in areas including but not limited to mass transit hubs. In this embodiment, when a dangerous hidden object is detected, the potential threat is isolated within the smart room by the revolving doors automatically stopping in response to an alarm signal. It should be noted that the design of each revolving door can contain different amounts of blades, or separations 310. Thus, a revolving door can have 2 sections 305, 3 sections, 4 sections, and so on. Also, the first revolving door need not contain the same amount of sections/blades as other doors making up the same smart room. For example, the first door can have 3 sections, while a second door has only two sections. It should also be noted that other embodiments can comprise more than two revolving doors in order to control the flow of persons and to create more isolated areas for additional screening (e.g., three revolving doors with 2 separate isolated areas).

In another embodiment of the present invention, a system is installed between two revolving doors (see FIGS. 1 and 4, for example). Individuals and their belongings 5 are screened while they are between the doors, and in the case of a detected and signaled threat (the signal is based on the detection means reaching a threshold level of detection of a particular material), the revolving doors stop, creating a closed, or lock mode, isolating the suspected individual. This provides time for additional scanning (e.g., about 10 frames per second) and if the alarm does not continue or accumulate, the revolving doors begin moving again. In such a case, interference/stoppage of traffic flow lasts only for a few seconds and appears normal. If, however, the alarm continues and/or accumulates, the threat must be taken seriously and the target remains trapped because the revolving doors do not resume motion. Several other detection means can be employed in various embodiments to continue to monitor and confirm the threat while a target is trapped within a smart room.

In yet another embodiment of the presently claimed system, a reflected microwave imaging screening method (see FIG. 5B, for example) is the means for detection employed in the smart room and/or the revolving doors. One microwave imaging portal is setup by placing pairs of transmitters 200 and receivers 100 across from each other, e.g. in opposite corners along a diagonal. More pairs of receivers and transmitters allow for a more angles of detection 202 to screen individuals travelling through the smart room 500 (see FIG. 4 for an illustration of one configuration of transmitters and receivers). An alarm is triggered if a signal from any of the screening mechanisms exceeds a pre-determined threshold value. The alarm can automatically, or according to a manual input by an operator, causes the smart room to lock (e.g., the revolving doors stop revolving) and isolate the target that caused the alarm. Alternatively, or additionally, a silent alarm can be triggered in a similar fashion (i.e. threshold value), in order to alert and obtain first responders before locking the smart room or otherwise alarming an individual carrying a potential explosive. Additional screening can occur via the same means or additionally coupled means for detection, which activate only for confirmation purposes (e.g., after an alarm is signaled). After further screening, the smart room can either remain locked (if the signal/alarm remains) or the doors will return to their normal function (e.g., revolving, opening-closing automatically).

In another embodiment also employing microwave imaging, the imaging can be performed via transmission of microwaves through objects located in the screening areas (see FIG. 5B, for example). In this particular embodiment, inspection of the object is based on analyzing the parameters of quasi-coherent microwave radiation transmitted through a monitored space. The dielectric constant, the shape, and the volume of an object carried on the body or in luggage are determined. Detection occurs by reconstructing a distribution of the dielectric constant value in the monitored space and then distinguishing the areas in space where dielectric constant values are close to the dielectric constant values of dangerous materials. The dielectric constant of the object is determined by measuring simultaneously a phase and an amplitude of a MW signal passing through the target. A single source or multiple sources of MW radiation may be used, as well as one receiver or multiple receivers of MW radiation. In some embodiments, the source(s) of radiation generate(s) radiation at multiple frequencies. The received signals are used to process changes in optical path lengths. The microwave signal transmitted through the interrogated object (e.g., a backpack) is compared with a signal which passes the same distance without the backpack in its way, i.e., an "optical path length through free space." The change in the optical path length of the microwave is calculated by measuring the shift between the maximum values of signal conversion (using the equation below) and its relative value when there is no object at all.

The equation used to calculate the maximum values discussed above is as follows:

$$|F(x)|^2 = \left(\sum_{i=1}^{Nf} \frac{A_i}{A_0} \cdot \cos\left(\varphi_i - \varphi_0 + 2\pi \frac{x \cdot f_i}{c}\right)\right)^2 + \left(\sum_{i=1}^{Nf} \frac{A_i}{A_0} \cdot \sin\left(\varphi_i - \varphi_0 + 2\pi \frac{x \cdot f_i}{c}\right)\right)^2$$

where Nf=number of frequencies, $f_i$=corresponding frequencies, $A_i$=amplitude of the signal transmitted through the inspected object, $A_0$=amplitude of "free space" signal, $\phi_i$=phase of the signal transmitted through the inspected object, $\phi_{i_0}$=phase of "free space" signal, C=speed of light in vacuum, and x=parameter showing the distance value.

Together with the measurement of the optical path lengths, the geometric dimensions and shape of the inspected object can also be measured by constructing a 3D stereo optical image of the object using, e.g., a system of video cameras comprising a stereo video pair. Joint information about dimensions of the inspected object and value showing the lengthening of the optical path of electromagnetic waves of the chosen frequency range makes it possible to determine the dielectric constant of the object, which, together with measurements of geometric dimensions and shape analysis, is used to determine a danger level of a screened object (by comparing the object's characteristics with reference characteristics of explosives and explosive devices).

In the event that a detected person is actually carrying an explosive, and in the case of a possible detonation, the damage to the surrounding areas and individuals is reduced by (1) concrete and (2) blast-resistant glass or other blast-resistant material, strategically located in specific positions to deflect and minimize a blast impact (see FIG. 1, for example). The blast-resistant glass can optionally be coated (i.e. coupled with) plexi-glass material. Concrete and blast-resisting glass in the walls of the system, the material comprising the revolving doors, and/or in areas immediately surrounding the smart room, in combination with a screening mechanism, perform at least the following functions: (a) the detection, potentially one-by-one (passing through), in mass transit, (b) automatically stopping/isolating a target if and when detected, (c) allowing more time for other technology (e.g. not real-time technology) to further resolve an initial alarm, and (d) mitigating damage in case of explosion or other dangerous act (by, e.g., reducing blast pressure).

In another embodiment of the present invention, the screening, or detection, means can be employed in both the sections of the revolving doors and the isolated area(s) between the doors, thus allowing for a double-, triple-, and so on, ability to monitor a target (thus resulting in more accurate screening and alarm rates). The transmitters 200 can be placed across from the receivers 100 in a number of fashions, both within the revolving doors 300 and within an area between the doors 500.

The description of a preferred embodiment of the invention has been presented for purposes of illustration and description. It is not intended to be exhaustive or to limit the invention to the precise forms disclosed. Obviously, many modifications and variations will be apparent to practitioners skilled in this art. It is intended that the scope of the invention be defined by the following claims and their equivalents.

Moreover, the words "example" or "exemplary" are used herein to mean serving as an example, instance, or illustration. Any aspect or design described herein as "exemplary" is not necessarily to be construed as preferred or advantageous over other aspects or designs. Rather, use of the words "example" or "exemplary" is intended to present concepts in a concrete fashion. As used in this application, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

What is claimed is:

1. A security system for screening of individuals, comprising:

two stationary cylinders, a revolving mechanism situated within each stationary cylinder comprising at least one blade comprised of blast-resistant material forming a revolving door, and an isolated area comprising at least two walls, located between said two stationary cylinders, the walls being parallel each other and connected to the two stationary cylinders forming the isolated area limited by the walls and the two stationary cylinders;

one or more detectors within the isolated area;

wherein the blast-resistant material has characteristics such that the material is able to contain a detonated explosive blast within the isolated area;

wherein the two stationary cylinders are the only entrance or exit from the isolated area;

wherein an individual travels through one of the stationary cylinders as an entrance cylinder, then through the isolated area, and finally through another of the stationary cylinders as an exit cylinder, as each of the revolving doors spin continuously around an axis in their respective stationary cylinders, creating a flow for continuous screening of moving individuals; and wherein the individuals move in both directions through the stationary cylinders and the isolated area.

2. The security system of claim 1, wherein at least one of the one or more detectors comprises a reflected microwave imaging system.

3. The security system of claim 1, wherein at least one of the one or more detectors comprises a transmitted microwave imaging system.

4. The security system of claim 1, wherein at least one of the one or more detectors comprises microwave imaging synchronized with video imaging.

5. The security system of claim 1, further comprising an automatic locking mechanism wherein the revolving doors stop to seal the isolated area in response to an alarm signaling an exceeded threshold to place a suspected individual in isolation.

6. The security system of claim 1, further comprising a silent alarm emitted in response to a threshold-exceeding signal from at least one of the one or more detectors to alert authorities without alerting a suspected individual.

7. The security system of claim 1, further comprising a blast-resisting material within said walls of the isolated area, the walls made of material with such characteristics that the material is able to isolate a detonated explosive inside the isolated area.

8. The security system of claim 1, further comprising a blast-resisting material structure adjacent to the isolated area.

9. The security system of claim 1, wherein some individuals are moving in one direction, while other individuals are moving in opposite direction simultaneously.

10. A system for detection of illegal articles worn or carried by individuals, comprising:

a detector employed in a first stationary cylinder, comprising at least one blade comprised of blast-resistant material forming a revolving mechanism within said first stationary cylinder;

a second detector employed in a second stationary cylinder, comprising at least one blade comprised of blast-resistant material forming a second revolving mechanism within said second stationary cylinder;

an isolated area located between the first and second stationary cylinders with at least two walls of blast-resistant material;

wherein the blast-resistant material has characteristics such that the material is able to contain a detonated explosive blast within the isolated area;

wherein the two stationary cylinders are the only entrance or exit from the isolated area; and a third detector employed in an isolated area located between said first and second stationary cylinders and the at least two walls, wherein said revolving mechanisms stop to seal the isolated area upon a threshold-exceeding signal received from said first, second, or third detectors;

wherein the individuals move in both directions through the stationary cylinders and the isolated area.

11. The security system of claim 10, further comprising a blast-resisting material structure adjacent to the isolated area.

12. The security system of claim 10, further comprising a silent alarm emitted in response to a threshold-exceeding signal from said first, second, or third detectors to alert authorities before sealing the isolated area and without alerting a suspected individual.

13. The security system of claim 10, wherein said first, second, and third detectors each comprise transmitted or reflected microwave imaging.

14. A security system for screening of individuals, comprising:

two automatic doors, and an isolated area comprising at least two walls, located between said two automatic doors, the walls being parallel each other and connected to the automatic doors to form the isolated area limited by the walls and the automatic doors;

one or more detectors with the isolated area;

wherein the automatic doors and the walls are made of material with characteristics such that the material is able to contain a detonated explosive blast within the isolated area;

wherein the two automatic doors are the only entrance or exit from the isolated area;

wherein the one or more detectors are is employed within the isolated area as an individual travels through one automatic door as an entrance door, through the isolated area, and finally through another automatic door as an exit door, as the two automatic doors continuously open and close, setting a pace for continuous screening of moving individuals; and wherein the individuals are moving through the isolated area in both directions.

15. The security system of claim 14, further comprising an automatic locking mechanism wherein the automatic doors close to seal the isolated area upon a threshold-exceeding signal received from at least one of the one or more detectors and place a suspected individual in isolation.

16. The security system of claim 14, further comprising a silent alarm emitted in response to a threshold-exceeding signal from at least one of the one or more detectors to alert authorities before sealing the isolated area and without alerting a suspected individual.

17. The security system of claim 14, further comprising blast-resisting material within the walls of the isolated area.

18. The security system of claim 14, further comprising at least one blast-resisting material structure adjacent to the isolated area.

19. The security system of claim 14, wherein at least one of the one or more detectors comprise a microwave imaging system synchronized with a video imaging system.

* * * * *